US009045263B2

(12) United States Patent
Fox et al.

(10) Patent No.: US 9,045,263 B2
(45) Date of Patent: Jun. 2, 2015

(54) CHILD-RESISTANT CLOSURE

(75) Inventors: Jamie Fox, Norwich (GB); Darren John Mears, Sprowston (GB); Stephen Faragher, Norwich (GB)

(73) Assignee: Obrist Closures Switzerland GmbH, Reinach (CH)

( * ) Notice: Subject to any disclaimer, the term of this patent is extended or adjusted under 35 U.S.C. 154(b) by 0 days.

(21) Appl. No.: 13/824,979

(22) PCT Filed: May 14, 2012

(86) PCT No.: PCT/GB2012/000425

§ 371 (c)(1),
(2), (4) Date: Jun. 13, 2013

(87) PCT Pub. No.: WO2013/041821

PCT Pub. Date: Mar. 28, 2013

(65) Prior Publication Data

US 2013/0270273 A1 Oct. 17, 2013

(30) Foreign Application Priority Data

Sep. 22, 2011 (GB) ..... 1116447.2

(51) Int. Cl.

| | |
|---|---|
| ***B65D 50/04*** | (2006.01) |
| ***B65D 41/06*** | (2006.01) |
| ***B65D 47/14*** | (2006.01) |

(Continued)

(52) U.S. Cl.

CPC ..... *B65D 43/0285* (2013.01); *B65D 47/0838* (2013.01); *B65D 50/046* (2013.01); *B65D 2215/02* (2013.01); *B65D 2251/1058* (2013.01)

(58) Field of Classification Search

CPC ..... B65D 47/0809; B65D 50/046
USPC ..... 215/216, 225, 224, 272, 221, 220, 219, 215/213, 209, 201, 200, 244, 245, 237; 220/835, 326, 834

See application file for complete search history.

(56) References Cited

U.S. PATENT DOCUMENTS 3,747,793 A * 7/1973 Wassilieff ..... 215/250
7,296,711 B2 * 11/2007 Hayakawa et al. ..... 222/153.14

(Continued)

FOREIGN PATENT DOCUMENTS

| | | | |
|---|---|---|---|
| DE | 3625477 | C2 | 8/1994 |
| EP | 1502871 | A2 | 2/2005 |
| WO | 2011073606 | A1 | 6/2011 |

OTHER PUBLICATIONS

European Patent Office, International Search Report and Written Opinion of PCT/GB2012/000425, Jul. 17, 2012, 14 pages.

(Continued)

*Primary Examiner* — Mickey Yu
*Assistant Examiner* — Allan Stevens
(74) *Attorney, Agent, or Firm* — Alleman Hall McCoy Russell & Tuttle LLP

(57) ABSTRACT

A child-resistant closure includes a body with a base and a lid, the closure having a locked position in which the lid is held in a closed position and an unlocked position in which the lid is released and can be moved to an open position. The sidewall has one or more pressing pads for moving the closure to the unlocked position. The or each pad is supported on the sidewall by force insulating links which restrict lateral spreading of forces into the sidewall during inward deflection of the pad(s).

20 Claims, 8 Drawing Sheets

(51) Int. Cl.
*B65D 43/02* (2006.01)
*B65D 47/08* (2006.01)

(56) References Cited

U.S. PATENT DOCUMENTS 7,798,348 B2 * 9/2010 Sawyer ..... 215/237
2005/0205607 A1 9/2005 Hierzer et al.

OTHER PUBLICATIONS

Intellectual Property Office of Great Britain, Search Report of British Patent Application No. GB1116447.2, Jan. 17, 2012, 3 pages.

* cited by examiner

CHILD-RESISTANT CLOSURE

CROSS-REFERENCE TO RELATED APPLICATIONS

The present application is the U.S. National Phase of International PCT Application Serial No. PCT/GB2012/000425, entitled "A Child-Resistant Closure," filed May 14, 2012, which claims priority to Great Britain Application No. 1116447.2, filed Sep. 22, 2011, each of which are hereby incorporated by reference in their entirety for all purposes.

The present invention relates generally to a child-resistant container closure and particularly to a closure in which squeezing and/or pressing is required in order to gain access to part of the closure and/or to an associated container.

Many different types of safety closure, or child-resistant closure, have been proposed. It is known to provide closures in which a base and a lid are provided, where in order to open the lid, part of the base must be squeezed, usually to release a lug or the like which retains the lid. An example of this type of closure is disclosed in DE3625477.

In any child-resistant closure one important consideration is the balance between being easy enough for adults to open and yet not so easy that a child can gain access. In known "squeeze to release" closures there can be problems with the amount of deflection permitted which then results in difficulties releasing the lugs.

The present invention seeks to address the problems with known child-resistant, squeeze-to-release closures.

According to a first aspect of the present invention there is provided a child-resistant closure comprising a body with a sidewall and including locking means, the sidewall having one or more pressing pads for releasing the locking means, the or each pad being supported on the sidewall by force insulating links which restrict lateral spreading of forces into the sidewall during inward deflection of the pad.

According to a second aspect of the present invention there is provided a child-resistant closure comprising a body connectable to a container, the body having a body wall and having locking means for providing a child-resistant function, the body further having one or more pressing pads forming part of the body wall for releasing the locking means, the or each pad being connected to the body wall by one or more insulating links which block inward deflection of the pad from spreading into adjacent regions of the body wall.

The links isolate the pad from the sidewall so that when the pad is pressed the inward deflection is maximised because the deflection force does not spread into the sidewall. This provides for improved deflection of the pad.

The link serves as a deflection 'break' which isolates the pad from the sidewall on/in which it is provided.

By using links which connect the pad to the wall it is possible to form the wall in such a way that there are no dust traps or trapping risks created, with a continuous surface provided.

The pad-sidewall interface may be formed as an articulated linkage.

The pad-body interface may be formed as a floating hinge.

A 'batwing' configuration may be used for the or each link.

The links may flank the pad. Lateral and/or longitudinal flanking may be provided.

The body may have two pressing pads, although one pad, three pads, or more than three pads are contemplated.

Diametrically opposed pads may be provided.

The or each link may be generally V-shape. The included angle of the V-shape may be in the range of 10° to 170°, such as 45° to 150°. For example, the included angle of the V-shape may be approximately 130°.

The link may comprise a plurality of corrugations.

The link may be at least partly curved. In some embodiments the link may be generally sinuous.

The link may comprise a material thickening. Differential thickening and/or different materials may be used to isolate the pressing force.

The body may be generally cylindrical. Other shapes such as oval, conical or square forms may be used.

The closure may be formed from a plastics material, for example by a moulding process such as injection moulding.

The body may comprise a base and a lid and the locking means may lock the lid in a closed position.

The base may comprise a recess defining an exposed peak on the lid.

The pad may be provided at or in the region of an end of the sidewall. Alternatively or additionally a pad may be provided within the sidewall.

The pad may be provided as part of a larger panel with the link(s) operable to prevent spreading into the surrounding panel.

The closure may comprise a base and a lid, the base having an inner skirt and an outer skirt, the closure having locking means for releasably locking the lid in a closed position, the outer skirt having one or more pressing pads which can be pressed to release the locking means, in which the inner skirt has one or more cut-outs in register with the or each pressing pad whereby to allow greater deflection thereof.

By providing cut-outs in the inner skirt the outer skirt can be deflected further inwards to disengage the locking means. A reduction in materials can result, both from the removal of material to make the cut-outs and material savings which can be made due to the increased wall deflection.

The locking means may comprise a locking lug movable to an unlocked position by the pressing zone. Typically the lug would be biased to a locking position to allow re-set.

The lid may have one or more slots for receiving the or each locking lug and in the locked position the lug(s) may project through the slot(s).

The lid may be connected to the base by a hinge, such as a snap hinge. Alternatively the lid may be releasable from the base.

The pressing zone(s) may each comprise a pressing pad. In some embodiments the zone may comprise a recessed panel. The locking means may be carried on or by the zone.

The outer skirt may comprise two pressing zones with the inner skirt comprising two corresponding cut-outs. The zones may be diametrically opposed to each other.

The closure base may further comprise a finger recess for lifting the lid following release of the locking means. The finger recess may be positioned diametrically opposite an articulation member such as a hinge if present.

The inner skirt may comprise retention means for securing the closure to a container. The retention means comprise a locking bead, which may be segmented.

The cut-out may comprise a notch. The notch may extend over part of the full height of the inner wall, or may extend over substantially the full height of the inner wall. Alternatively, the cut-out may comprise a window in the inner wall.

Different aspects and embodiments of the invention and the features thereof may be used together or separately.

The present invention will now be more particularly described, by way of example, with reference to the accompanying drawings, in which.

Figure 1:
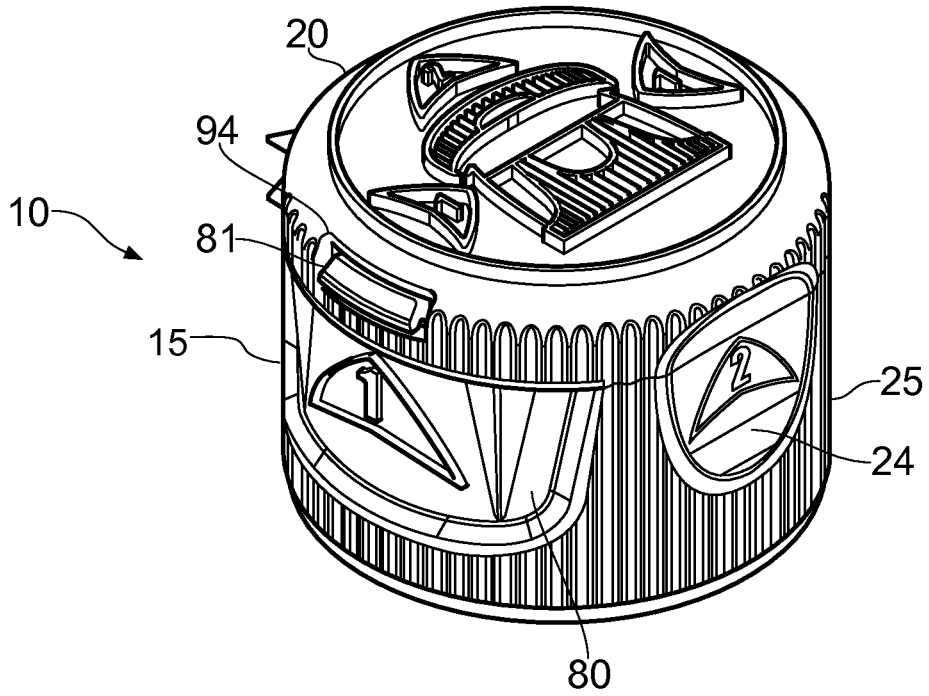
FIG. 1 is a perspective view of a closure formed in accordance with the present invention and shown in a closed position.

As shown in the figures, a closure is provided and is generally indicated at 10. The closure 10 comprises a base 15 and a lid 20.

The base 15 comprises a generally cylindrical outer skirt 25. At the end of the skirt 25 which is adjacent to the lid an annular deck 30 extends radially inwardly. The inner periphery of the deck 30 terminates with an upwardly (with reference to the lid) inclined spout section 40. At the inner periphery of the spout section 40 a truncated spout skirt 45 depends and defines an aperture 47. At the outer periphery of the spout section where it joins the flat section of the deck an inner skirt 50 depends. The inner skirt 50 has two diametrically opposed windows 65, 70.

The outer skirt 25 includes two diametrically opposed generally elongated U-shape recesses defined by panels 80, 85. The recesses are in register with the windows 65, 70 as will be discussed in more detail below.

Each panel 80, 85 carries a lug 81, 86 at its free end which projects above the deck. Between each panel and the deck 30 is an arcuate slot 31, 32.

Each lug 81, 86 comprises a chamfered upper surface 82, 87 and an undercut lower surface 83, 88.

Figure 7:
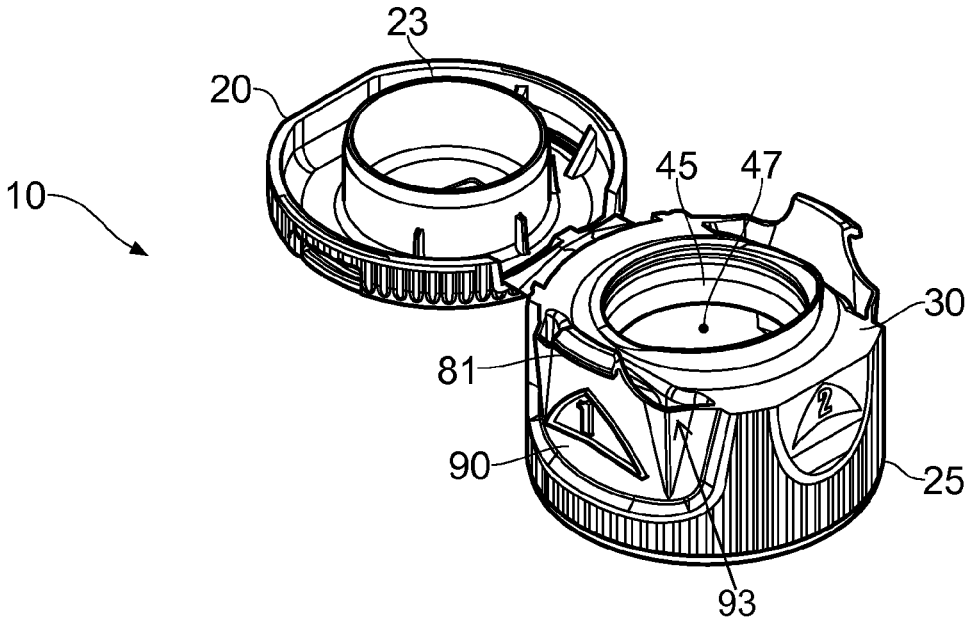
FIG. 7 is a perspective view of the closure of FIG. 1 shown in an open position.
Figure 8:
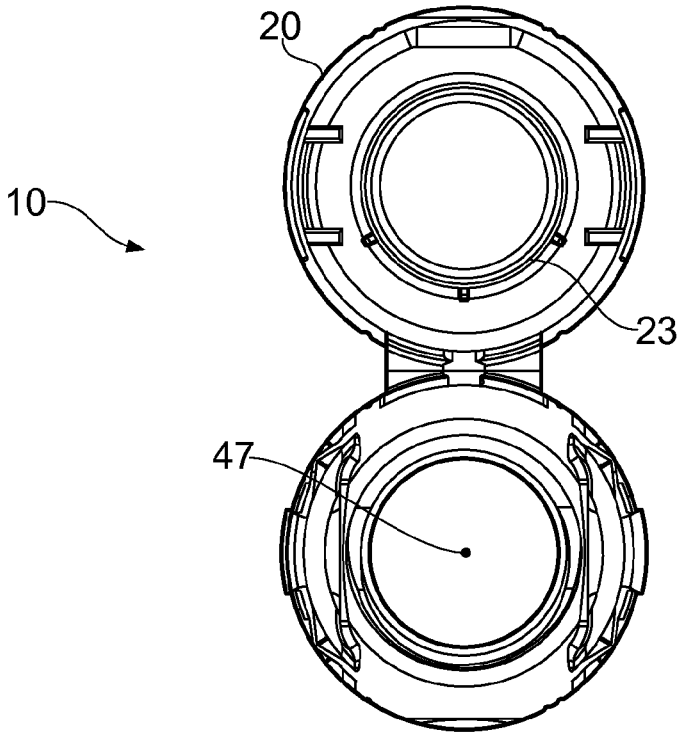
FIG. 8 is a plan view of the closure of FIG. 7.
Figure 9:
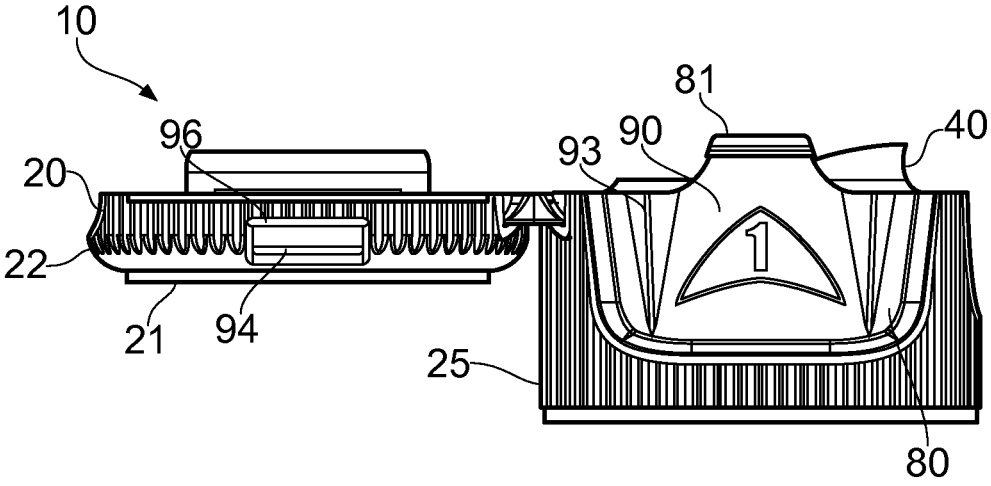
FIG. 9 is a side view of the closure of FIG. 7.
Figure 10:
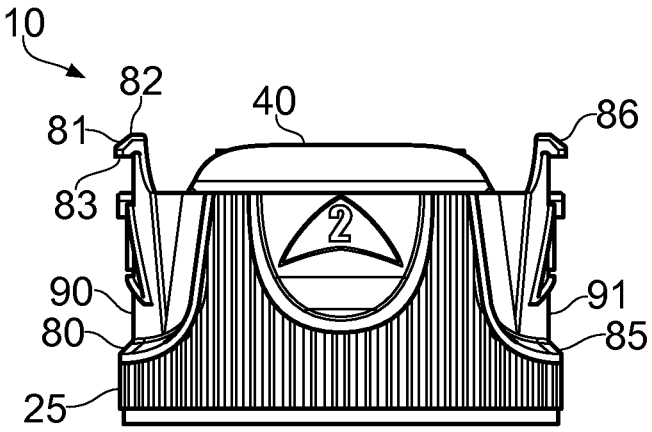
FIG. 10 is a front view of the closure of FIG. 7.
Figure 11:
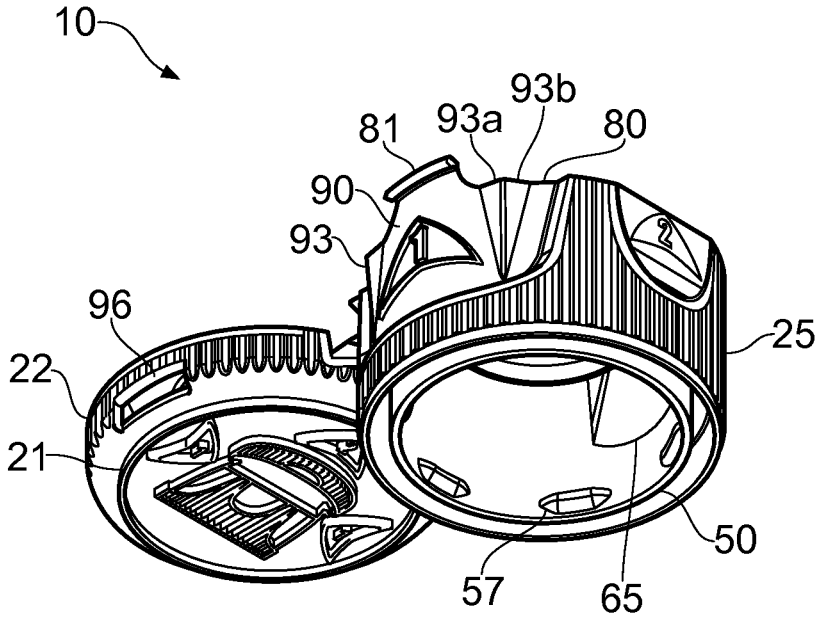
FIG. 11 is an underplan perspective view of the closure of FIG. 7.
Figure 12:
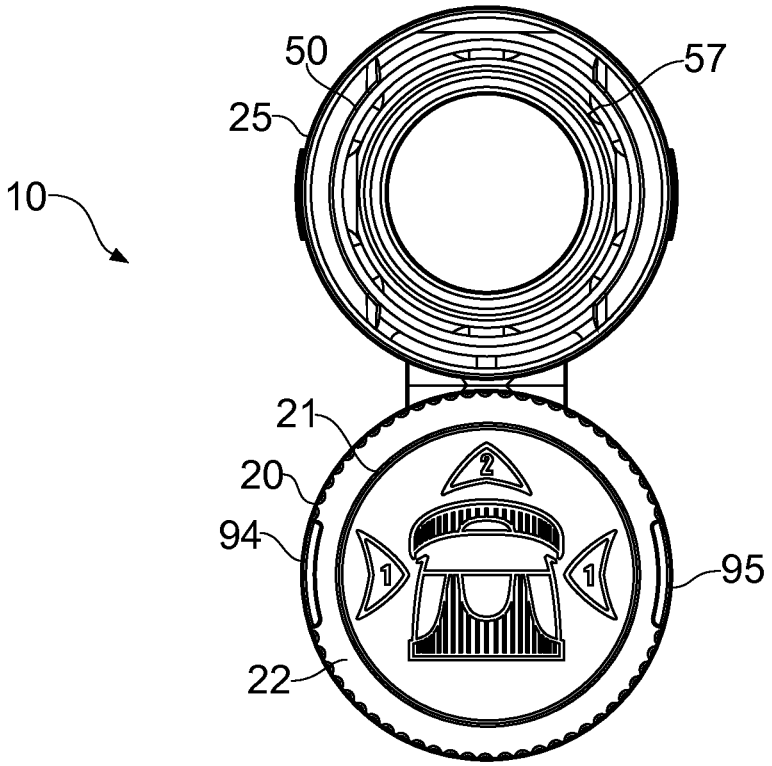
FIG. 12 is an underplan view of the closure of FIG. 7.

Each panel 80, 85 includes a respective central pad 90, 91. Each pad 90, 91 is flanked by a pair of links 93. Each link 93 comprises a pair of opposed, elongated right-angled triangular panels 93*a*, 93*b* arrange as a v-form, elbow-like hinge. As may be seen in FIG. 7, for example, link 93 may comprise a floating hinge.

Figure 6:
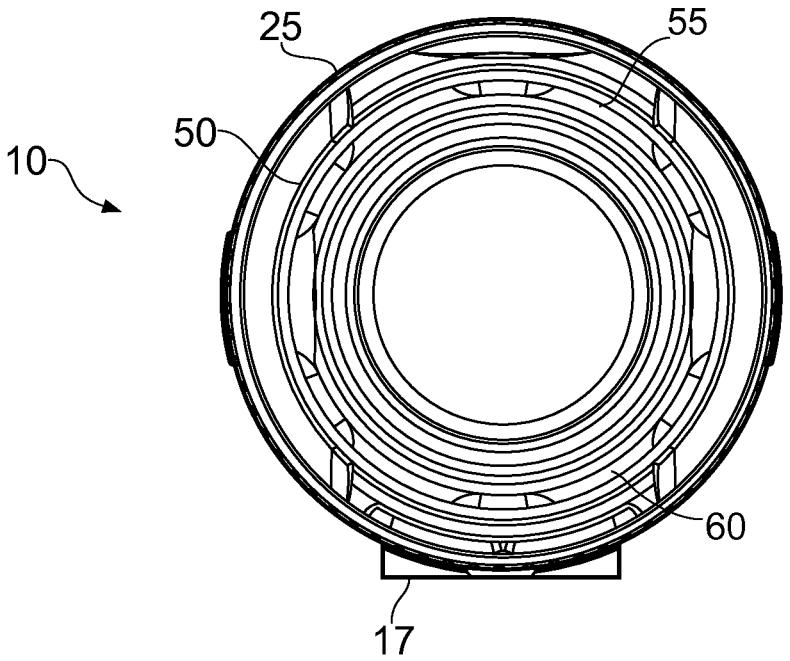
FIG. 6 is an underplan view of the closure of FIG. 1.
Figure 13:
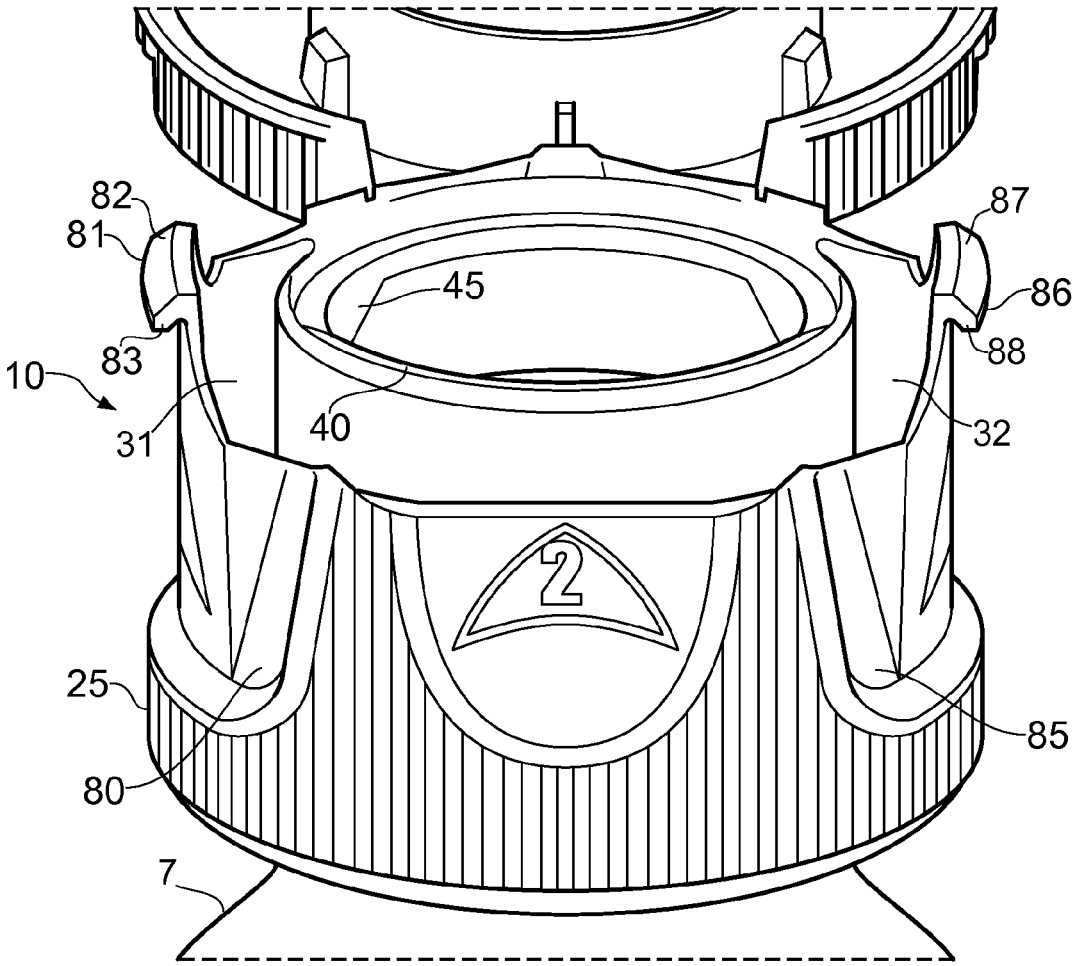
FIG. 13 is a partial front perspective view of the closure of FIG. 7.
Figure 14:
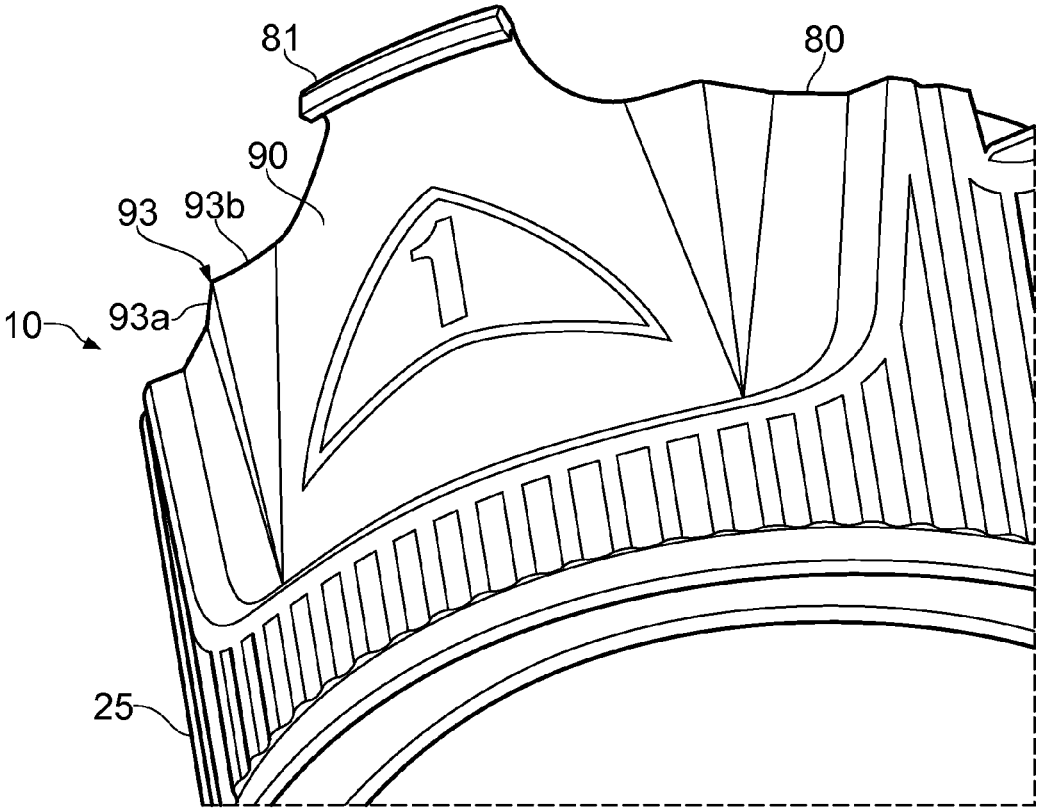
FIG. 14 is a magnified view of a pressing pad of the closure of FIG. 13.

Inner skirt 50 comprises two arcuate inner skirt sections 55, 60. Each of the arcuate inner skirt sections 55, 60 comprises three spaced bead sections 57 at their free end, as shown in FIG. 6. In use, the spaced bead sections 57 may engage on a corresponding snap bead (not shown) on a container neck (e.g., container neck 7 shown in FIG. 13).

The base 15 and lid 20 are joined by a hinge 17, which in this embodiment is a snap hinge. Diametrically opposite the hinge a finger recess 24 is positioned in the outer skirt 25.

The lid 20 comprises a generally circular top plate 21 with a truncated side skirt 22 depending from its periphery except for the region where the hinge 17 is attached.

A centrally positioned annular spigot 23 depends from the top plate 21 and is dimensioned to be a tight fit in the aperture 47 defined by the spout 40 in the base when the lid is in the closed position.

Two diametrically opposed slots 94, 95 are positioned in the lid 20 at the intersection of the skirt 22 and top plate 21. The slots are positioned so that when the lid is closed onto the base the lugs 81, 86 are engaged and firstly the chamfered portion 82, 87 of the lugs engages the free end of the skirt whereupon they are caused to deflect inwards until the lug passes into the slots whereupon they spring outwards to fill the slots. The lower surfaces 83, 88 of the lugs then engage onto the lower, ledge-like slot faces 96, 97 of the skirt sections which defines the slots 94, 95.

In use, the pads 90, 91 are depressed to move the lugs inwards. This releases the lugs from the lid slots. When the pads are deflected inwards they flex. The flexing is substantially constrained to be by the pads because the links 93 prevent lateral spreading of the forces into the adjacent panel sections. This maximises the inward deflection of the pads and hence the lugs.

The panels are resilient and the pads automatically spring back after release.

Figure 2:
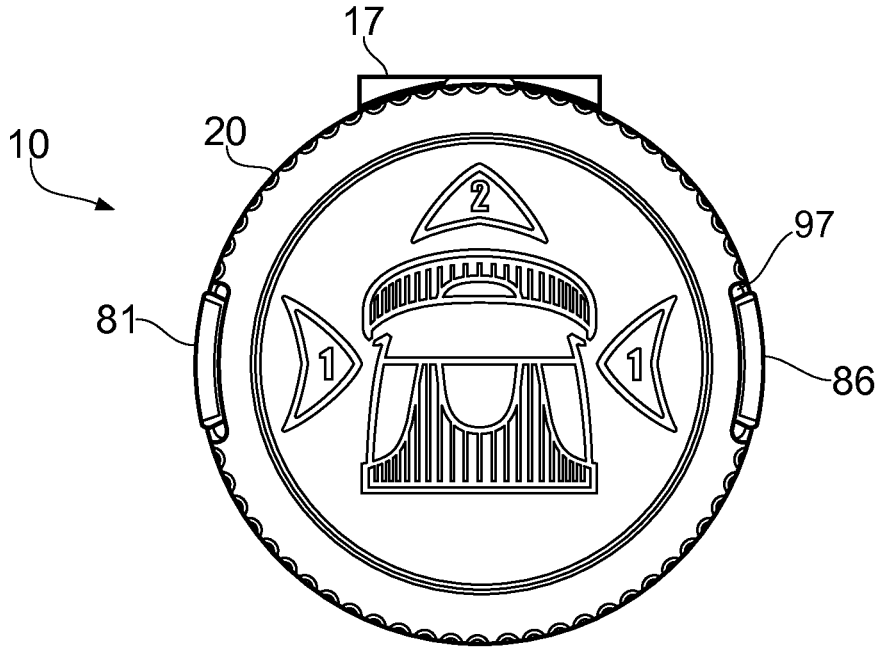
FIG. 2 is a plan view of the closure of FIG. 1.
Figure 3:
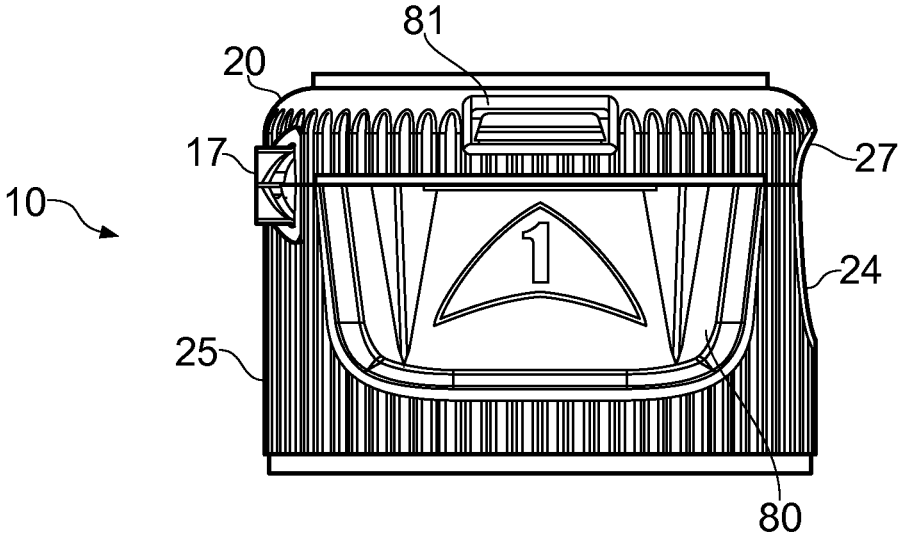
FIG. 3 is a side view of the closure of FIG. 1.
Figure 4:
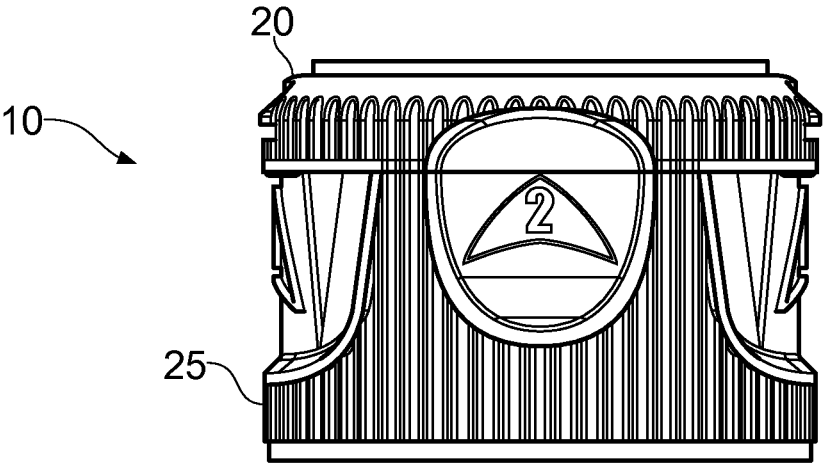
FIG. 4 is a front view of the closure of FIG. 1.
Figure 5:
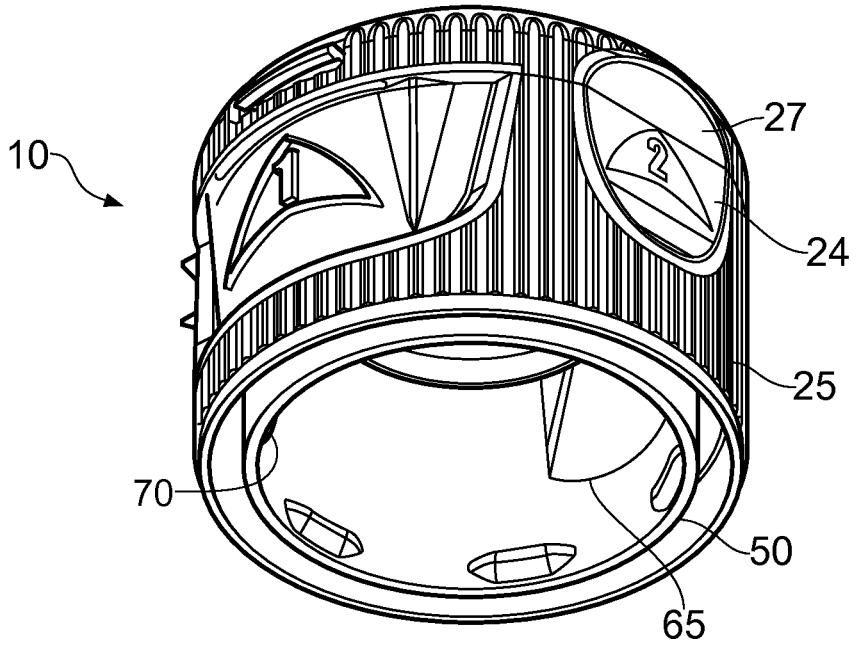
FIG. 5 is an underplan perspective view of the closure of FIG. 1.

In this closed position shown in FIGS. 4 and 6 the lid cannot be lifted because the slot faces 96, 97 and lug surfaces 83, 88 are in abutment. In order to open the lid the recess panels must be pressed inwards to move the lugs out of the slots. Because the panels 80, 85 are in register with the windows 65, 70 the panels can be deflected further radially inwards. At the same time the lugs are moved inwards the finger recess must be used to flip open the lid as is shown diagrammatically on the top of the lid in FIG. 2. The underside of the lid is provided with a trough 27 in register with the finger recess 24 in the closed position which serves as a leverage point to lift the lid.

In other embodiments (not shown) the closure may, for example, be formed as a lid connectable to a container. The pads are operable to release the lid from the container.

The invention claimed is:

1. A child-resistant closure comprising a body connectable to a container, the body comprising a base having an outer skirt and a lid, the lid being movable between a closed position and an open position, the closure having a locked position in which the lid is held in the closed position and an unlocked position in which the lid is released and can be moved to the open position, the outer skirt including two diametrically opposed panels, each of said panels having a central pad which is depressible to move the closure to the unlocked position, each of said pads being flanked by a pair of links, said links comprising V-form hinges forming a continuous surface between each pad and adjacent regions of the corresponding panel.

2. The closure as claimed in claim 1, in which each link is generally V-shaped.

3. The closure as claimed in claim 1, in which the body is generally cylindrical.

4. The closure as claimed in claim 1, in which the base includes a spout section.

5. The closure as claimed in claim 1, in which the base further comprises an inner skirt, the inner skirt having one or more windows in register with the pads whereby to allow greater deflection thereof, in which a free end of the inner skirt extends so that it terminates at approximately the same position as the outer skirt.

6. The closure as claimed in claim 1, in which the lid is locked in the closed position by one or more locking lugs movable to the unlocked position by the pads, in which the lid has one or more slots for receiving the one or more locking lugs, and in which in the locked position of the lid the lug(s) project at least partly into the slot(s).

7. The closure as claimed in claim 1, in which the pads are resilient.

8. A child-resistant closure comprising a body connectable to a container, the body comprising a base having a body wall, and a lid, the lid being movable between a closed position and an open position, the closure having a locked position in which the lid is held in the closed position and an unlocked position in which the lid is released and can be moved to the open position, the body wall including one or more pressing zones which are deflectable to move the closure to the unlocked position, each pressing zone being flanked by a pair of links, said links being generally V-shaped and forming a continuous surface between each pressing zone and adjacent regions of the body wall, and said links causing flexing forces to remain within the one or more pressing zones during deflection.

9. The closure as claimed in claim 8, in which the one or more pressing zones are each laterally flanked by said links.

10. The closure as claimed in claim 8, in which the body has two pressing zones.

11. The closure as claimed in claim 10, in which the pressing zones are diametrically opposite to each other.

12. The closure as claimed in claim 8, in which the one or more pressing zones are provided at or in a region of an end of the body wall.

13. The closure as claimed in claim 8, in which the base has an inner skirt and an outer skirt, the or one or more pressing zones provided on the outer skirt, in which the inner skirt has one or more windows in register with the one or more pressing zones whereby to allow greater deflection thereof.

14. The closure as claimed in claim 13, in which a free end of the inner skirt extends so that it terminates at approximately the same position as the outer skirt.

15. The closure as claimed in claim 8, in which the lid is locked in the closed position by one or more locking lugs movable to the unlocked position by the pressing zone(s).

16. The closure as described in claim 15, in which the lid has one or more slots for receiving the one or more locking lugs, and in which in the locked position of the lid the lug(s) project at least partly into the slot(s).

17. The closure as claimed in claim 8, in which the one or more pressing zones each comprise a recessed panel.

18. The closure as claimed in claim 8, in which the one or more pressing zones are resilient.

19. The closure as claimed in claim 8, in which the body is generally cylindrical.

20. The closure as claimed in claim 8, in which the base includes a spout section.

* * * * *